US007795540B2

(12) United States Patent
Yamada et al.

(10) Patent No.: US 7,795,540 B2
(45) Date of Patent: Sep. 14, 2010

(54) EXTENDABLE CABLE OR EXTENDABLE CONNECTING MEMBER

(75) Inventors: Kazuhiko Yamada, Tokyo (JP); Tomishige Tai, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 324 days.

(21) Appl. No.: 11/968,802

(22) Filed: Jan. 3, 2008

(65) Prior Publication Data

US 2008/0173463 A1 Jul. 24, 2008

(30) Foreign Application Priority Data

Jan. 22, 2007 (JP) ..... 2007-011161

(51) Int. Cl.
*H01B 7/00* (2006.01)

(52) U.S. Cl. ..... 174/117 R; 174/117 F; 174/117 FF

(58) Field of Classification Search ..... 174/110 R, 174/112, 113 R, 117 R, 117 F, 117 FF, 117 AS
See application file for complete search history.

(56) References Cited

U.S. PATENT DOCUMENTS 2,434,793 A * 1/1948 Feaster ..... 174/113 C
3,317,657 A * 5/1967 Eisler ..... 174/117 FF
3,413,405 A * 11/1968 Myers ..... 174/36
3,459,880 A * 8/1969 Erdle ..... 174/117 FF
4,746,769 A * 5/1988 Piper ..... 174/117 M
6,096,978 A * 8/2000 Pohjola ..... 174/117 FF
2004/0075520 A1* 4/2004 Nothhelfer et al. ..... 336/200
2007/0040628 A1* 2/2007 Kanno et al. ..... 333/4

FOREIGN PATENT DOCUMENTS

JP 2003-22713 A 1/2003

* cited by examiner

*Primary Examiner*—William H Mayo, III
(74) *Attorney, Agent, or Firm*—Frishauf, Holtz, Goodman & Chick, P.C.

(57) ABSTRACT

A cable includes an elastic member extendable and compressible in a first direction and a first conductor having a meandering portion embedded in the elastic member. The meandering portion meanders within the elastic member and extends in the first direction. It is preferable that a plurality of coating members are arranged in parallel in the first direction and coupled to a surface of the elastic member. In addition, it is preferable that each of the coating members is harder than the elastic member.

16 Claims, 2 Drawing Sheets

EXTENDABLE CABLE OR EXTENDABLE CONNECTING MEMBER

This application claims priority to prior Japanese patent application JP 2007-11161, the disclosure of which is incorporated herein by reference.

BACKGROUND OF THE INVENTION

This invention relates to a connecting member, such as a cable or a connector, which is adapted to be used for connection between connection objects.

For connection of various types of electric apparatuses, electric parts, electronic apparatuses, electronic parts, and circuit boards, a cable and/or a connector is often used. The cable and the connector will collectively be called a connecting member. As one example of the connecting member, a flat interconnection cable is disclosed in Japanese Unexamined Patent Application Publication (JP-A) No. 2003-22713. The flat interconnection cable includes a plurality of flat interconnection conductors arranged in parallel to one another and a flexible insulating member surrounding the flat interconnection conductors. The flexible insulating member is provided with a plurality of slits extending in parallel to the interconnection conductors.

However, the flat interconnection cables are not extendable and compressible and, therefore, may be heavily bent in a thickness direction if the flat interconnection cables are mounted and arranged in a small space. Thus, it is difficult to use the flat interconnection cables in a small space. As a result, restriction is imposed upon achievement of a space-saving layout.

SUMMARY OF THE INVENTION

It is therefore an exemplary object of this invention to provide a connecting member excellent in adaptability for use in a small space.

Other objects of the present invention will become clear as the description proceeds.

According to an exemplary embodiment of the present invention, there is provided a cable comprising an elastic member extendable and compressible in a first direction and a first conductor having a meandering portion embedded in the elastic member, wherein the meandering portion meanders within the elastic member and extends in the first direction.

DESCRIPTION OF THE EXEMPLARY EMBODIMENTS

Figure 1:
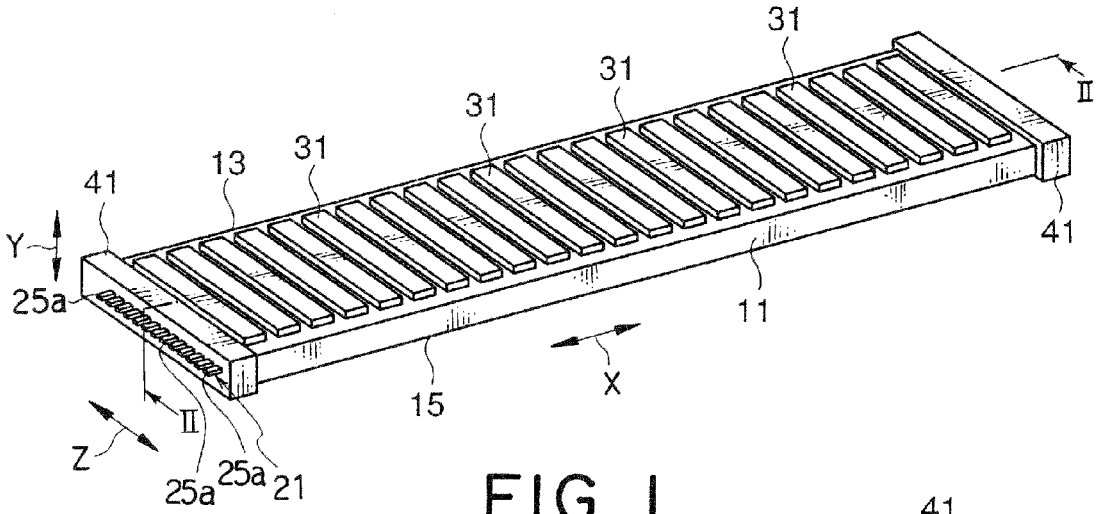
FIG. 1 is a perspective view of a connecting member according to an exemplary embodiment of this invention.
Figure 2:
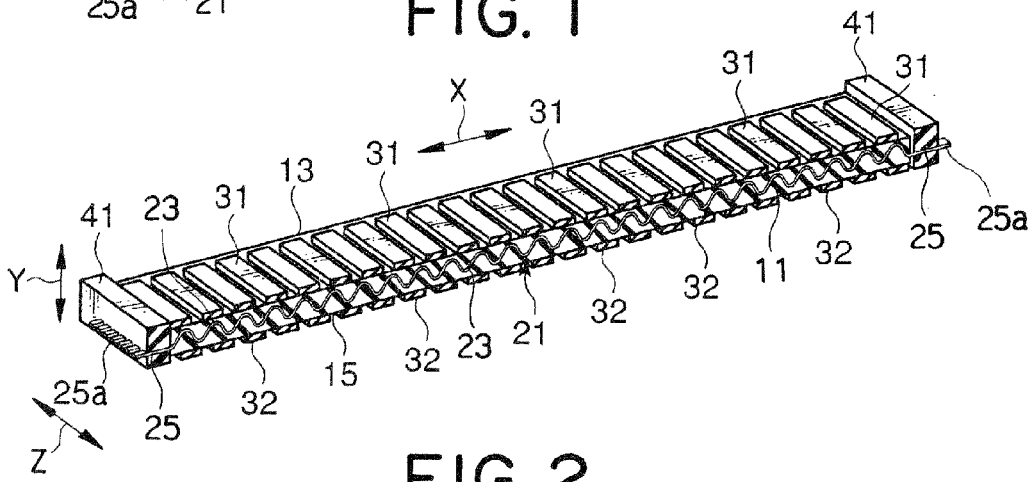
FIG. 2 is a sectional perspective view taken along a line II-II in FIG. 1.
Figure 3:
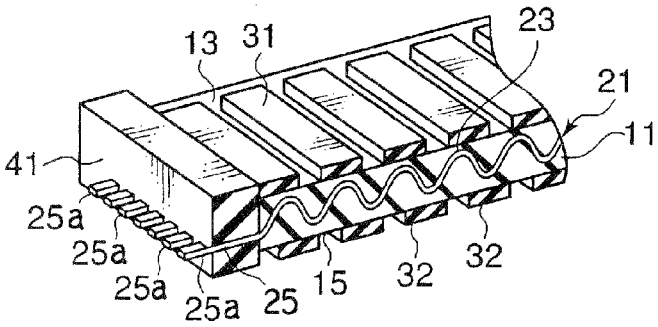
FIG. 3 is an enlarged perspective view showing a part in FIG. 2.

Referring to FIGS. 1 to 3, description will be made of a connecting member according to an exemplary embodiment of this invention.

The connecting member illustrated in the figure includes an insulating elastic member 11 of a rectangular plate-like shape extending in an axial direction, i.e., a first direction X, a plurality of conductors (wires) 21 extending through the elastic member 11, and a plurality of coating members 31 and 32 disposed on a surface of the elastic member 11. Each of the elastic members 11 comprises a so-called viscoelastic member made of a polymer material such as plastic.

Figure 4:
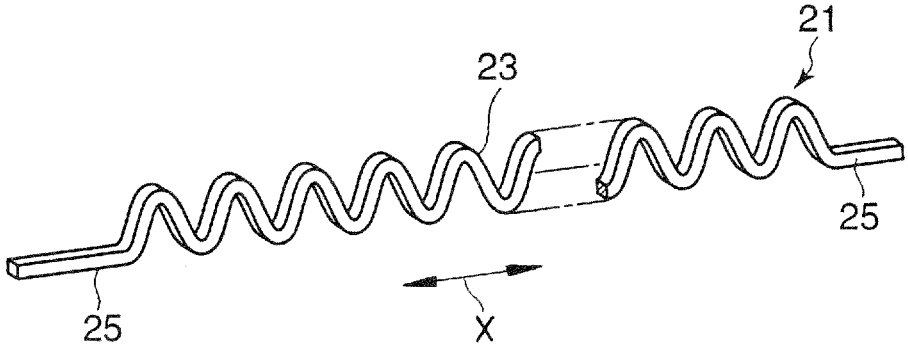
FIG. 4 is an enlarged sectional view of a conductor included in the connecting member illustrated in FIGS. 1 to 3.

As shown in FIG. 4 also, each conductor 21 has a meandering or bellows portion 23 embedded in the elastic member 11. The bellows portion 23 meanders within the elastic member 11 and extends in the first direction X. Each conductor 21 further has a pair of straight portions 25 which straightly extend from opposite ends of the bellows portion 23 in the first direction X and protrude outward of the elastic member 11. Each conductor 21 is formed by a metal strip plate having a narrow width. By bending the metal strip plate in a thickness direction, the bellows portion 23 is formed. The straight portion 25 has an end portion adapted to be connected to a connection object (not shown), such as an electric apparatus, an electric part, an electronic apparatus, an electronic part, and a circuit board. The straight portion 25 may be protruded from only one end face of the elastic member 11 in the first direction X.

The elastic member 11 has a first surface 13 and a second surface 15 faced to each other in the thickness direction as a second direction Y perpendicular to the first direction X. The first and the second surfaces 13 and 15 are provided with a plurality of coating members 31 and 32 which are arranged in parallel to one another in the first direction X with a space left therebetween and which are fixedly adhered to the first and the second surfaces 13 and 15, respectively.

Each of the coating members 31 and 32 is made of a material harder than the elastic member 11 and has a long plate-like shape extending in a third direction Z perpendicular to the first and the second directions X and Y. Herein, each of the coating members 31 and 32 is smaller in thickness than the elastic member 11. Arrangement of the coating members 31 and 32 is designed so that bending of the elastic member 11 is limited within a desired range by a dimension of the space between adjacent ones in the first direction X. In other words, arrangement of the coating members 31 and 32 is determined so that, when the elastic member 11 is bent, adjacent ones of the coating members 31 and 32 are brought into contact with each other in the first direction X.

Figure 5:
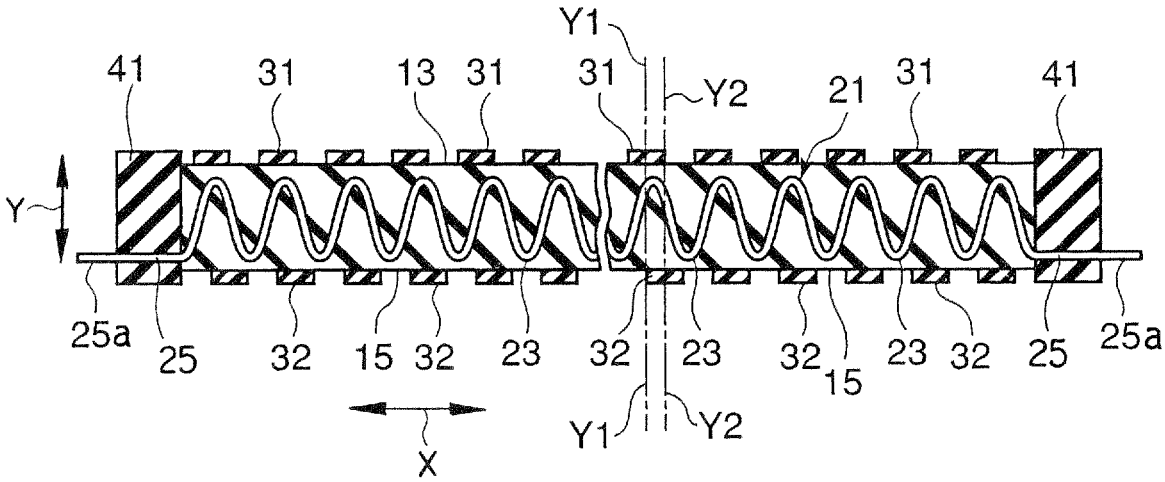
FIG. 5 is a sectional view taken along a line II-II in FIG. 5.

Referring to FIG. 5 in addition, the arrangement of the coating members 31 and 32 will continuously be described. The coating members 31 disposed on the first surface 13 of the elastic member 11 and the coating members 32 disposed on the second surface 15 are shifted in position from each other in the first direction X. Specifically, center lines Y1 of the coating members 31 on the first surface 13 are spaced from center lines Y2 of the coating members 32 on the second surface 15 in the first direction X.

In the connecting member described with reference to FIGS. 1 to 5, the elastic member 11 is extendable and compressible in the first direction X. Therefore, the bellows portions 23 of the conductors 21 are also extendable and compressible in the first direction X in compliance with the elastic member 11. Further, since two or more conductors 21 are arranged inside the elastic member 11 in parallel to one another in the third direction Z, the degree of freedom of bending of the bellows portion 23 is limited. Therefore, it is possible to suppress torsional deformation of the connecting member around the first direction X.

The coating members 31 and 32 are fixed to the first and the second surfaces 13 and 15 of the elastic member 11. Therefore, it is possible to restrict bending of the elastic member 11 in the second direction Y Specifically, when the elastic member 11 is bent in the second direction Y, a certain degree of bending is allowed at first. However, when a degree of bending is increased and adjacent ones of the coating members 31 and 32 are brought into contact with each other in the first direction X, further bending of the elastic member 11 is inhibited. As a consequence, it is possible to prevent excessive deformation of the bellows portion 23 of the conductor 21.

In order to produce the above-mentioned connecting member, the conductors 21 are at first located in parallel to one another with a space left therebetween. The elastic member 11 is formed so that the bellows portions 23 are embedded. In detail, the conductor 21 having the bellows portion 23 is placed in a molding die. A viscoelastic material of a two-component curable type or a thermally-curable type in an uncured state is poured into the molding die and then hardened. The straight portions 25 are protruded from the opposite end faces of the elastic member 11.

Thereafter, the coating members 31 and 32 are fixedly attached to the first and the second surfaces 13 and 15 of the elastic member 11, respectively. At this time, on each of the first and the second surfaces 13 and 15, the coating members 31 or 32 are spaced from one another. A space between the coating members 31 or 32 is determined so that, when the elastic member 11 is bent, adjacent ones of the coating members 31 and 32 are brought into contact with each other in the first direction X.

As a material of the elastic member 11, for example, a viscoelastic material of a gel type may be used. The viscoelastic material of the type is obtained by hardening a colloidal solution into a jelly-like state and has adherence. In case where the viscoelastic material of a gel type is used as the elastic member 11, the coating members 31 and 32 can be adhered to the first and the second surfaces 13 and 15 of the elastic member 11 by utilizing adherence of the elastic member 11 itself, respectively.

Each of the elastic member 11 and the coating members 31 and 32 may be made of a material such as natural rubber, silicone-based elastic rubber, or an acrylic material. In this event, the coating members 31 and 32 are adhered to the elastic member 11 by the use of an adhesive. In case where a rubber material or an acrylic material is used as the elastic member 11, a rubber material or an acrylic material harder than the elastic member 11 is used as the coating members 31 and 32.

The coating members 31 and 32 may be made of a metal material. In this case, an electromagnetic shielding effect is expected for the conductors 21.

As a material of the conductors 21, nickel, nickel alloy, monel metal, nickel vanadium, copper, phosphor bronze, and the like may selectively be used. The conductor 21 may be made of any other appropriate material, such as a conductive polymer material, which is electrically conductive and which is bendable.

The above-mentioned connecting member has a flexible structure comprising a plurality of conductive wires parallel to one another and covered with an insulator, like a typical flat cable. Therefore, the above-mentioned connecting member may be used as a cable for connection between connection objects.

Further, the elastic member 11 may be provided with a pair of insulating fixing members 41 disposed at opposite ends thereof. With this structure, the above-mentioned connecting member may be used as a connector for connecting connection objects to each other.

In case where the connecting member is used as a connector, the fixing members 41 are integrally formed with or fixedly attached to the elastic member 11 at opposite ends thereof. The straight portion 25 of each conductor 21 is fixed by the fixing member 41 so that a part of the straight portion 25 is exposed as a protruding part 25*a*. The protruding part 25*a* has rigidity and is adapted to be used as a connecting terminal to be fitted and connected to a mating connector (not shown). The protruding part 25*a* may protrude from only one end of the fixing member 41 in the first direction X.

As the fixing member 41, it is desired to use a material harder than the elastic member 11. As the fixing member 41, use may be made of natural rubber, silicone rubber, or an acrylic material.

Various exemplary embodiments of this invention will be enumerated in the following items 1-12.

1. A cable comprising:

an elastic member extendable and compressible in a first direction; and a first conductor having a meandering portion embedded in the elastic member, wherein the meandering portion meanders within the elastic member and extends in the first direction.

2. The cable according to the item 1, further comprising a plurality of coating members arranged in parallel in the first direction and coupled to a surface of the elastic member, each of the coating members being harder than the elastic member.

3. The cable according to the item 2, wherein the coating members are separated from one another in the first direction.

4. The cable according to the item 3, wherein the coating member are arranged so that, when the elastic member is bent, adjacent ones of the coating members are brought into contact with each other in the first direction.

5. The cable according to the item 1, wherein the elastic member has a first surface and a second surface faced to each other in a second direction perpendicular to the first direction, the coating members are arranged on each of the first and the second surfaces.

6. The cable according to the item 5, wherein the coating members are spaced from one another in the first direction on each of the first and the second surfaces.

7. The cable according to the item 5, wherein the coating members are shifted in position in the first direction between the first and the second surfaces.

8. The cable according to the item 5, wherein the meandering portion meanders in a plane containing the first and the second directions.

9. The cable according to the item 1, further comprising a fixing portion disposed at at least one end of the elastic member in the first direction, the first conductor having a straight portion extending from the meandering portion and fixed to the fixing portion.

10. The cable according to the item 9, wherein the straight portion has a protruding portion protruding from the fixing portion.

11. The cable according to the item 1, further comprising a second conductor extending through the elastic member in parallel to the first conductor.

12. The cable according to the item 11, wherein the first and the second conductors are arranged in parallel in a third direction perpendicular to the first and the second directions.

While the invention has been particularly shown and described with reference to the exemplary embodiment thereof, the invention is not limited to the foregoing embodiment. It will be understood by those of ordinary skill in the art that various changes in form and details may be made therein without departing from the spirit and scope of the present invention as defined by the claims.

What is claimed is:

1. A cable comprising:

an elastic member extendable and compressible in a first direction, the elastic member having a first surface and a second surface which are opposed to each other in a second direction perpendicular to the first direction;

a first conductor having a meandering portion embedded in the elastic member; and a plurality of coating members coupled to each of the first surface and the second surface of the elastic member, wherein the meandering portion meanders within the elastic member and extends in the first direction, wherein, on each of the first surface and the second surface, the coating members are separated from one another in the first direction with a space left therebetween, and wherein each of the coating members is harder than the elastic member.

2. The cable according to claim 1, wherein the coating members are arranged so that, when the elastic member is bent in the second direction, adjacent ones of the coating members are brought into contact with each other in the first direction.

3. The cable according to claim 1, wherein positions of the coating members coupled to the first surface are shifted in the first direction with respect to positions of the coating members coupled to the second surface.

4. The cable according to claim 1, wherein the meandering portion meanders in a plane containing the first and the second directions.

5. The cable according to claim 1, further comprising a fixing portion disposed at at least one end of the elastic member in the first direction, wherein the first conductor has a straight portion extending from the meandering portion and fixed to the fixing portion.

6. The cable according to claim 5, wherein the straight portion has a protruding portion protruding from the fixing portion.

7. The cable according to claim 1, further comprising a second conductor extending through the elastic member in parallel to the first conductor.

8. The cable according to claim 7, wherein the first and the second conductors are arranged in parallel in a third direction perpendicular to the first and the second directions.

9. The cable according to claim 1, wherein each of the coating members has a long plate-like shape extending in a third direction perpendicular to the first direction and the second direction.

10. The cable according to claim 9, wherein the coating members are arranged so that, when the elastic member is bent in the second direction, adjacent ones of the coating members are brought into contact with each other in the first direction.

11. The cable according to claim 9, wherein positions of the coating members coupled to the first surface are shifted in the first direction with respect to positions of the coating members coupled to the second surface.

12. The cable according to claim 9, wherein the meandering portion meanders in a plane containing the first and the second directions.

13. The cable according to claim 9, further comprising a fixing portion disposed at at least one end of the elastic member in the first direction, wherein the first conductor has a straight portion extending from the meandering portion and fixed to the fixing portion.

14. The cable according to claim 13, wherein the straight portion has a protruding portion protruding from the fixing portion.

15. The cable according to claim 9, further comprising a second conductor extending through the elastic member in parallel to the first conductor.

16. The cable according to claim 15, wherein the first conductor and the second conductor are arranged in parallel in the third direction.

* * * * *